US012680451B2

(12) United States Patent
Chen et al.

(10) Patent No.: US 12,680,451 B2
(45) Date of Patent: Jul. 14, 2026

(54) TUNNEL CONSTRAINT ANCHOR CABLE AND METHOD FOR IMPROVING STABILITY OF INITIAL SUPPORT STRUCTURE

(71) Applicant: Chang'an University, Xi'an (CN)

(72) Inventors: Jianxun Chen, Xi'an (CN); Lijun Chen, Xi'an (CN); Lixin Zhang, Xi'an (CN); Yanbin Luo, Xi'an (CN); Weiwei Liu, Xi'an (CN)

(73) Assignee: Chang'an University, Xi'an (CN)

( * ) Notice: Subject to any disclaimer, the term of this patent is extended or adjusted under 35 U.S.C. 154(b) by 142 days.

(21) Appl. No.: 18/776,222

(22) Filed: Jul. 17, 2024

(65) Prior Publication Data

US 2024/0368991 A1 Nov. 7, 2024

Related U.S. Application Data

(63) Continuation of application No. PCT/CN2023/076536, filed on Feb. 16, 2023.

(30) Foreign Application Priority Data

Mar. 30, 2022 (CN) ..... 202210338722.2

(51) Int. Cl.
*E21D 11/10* (2006.01)
*E21D 20/02* (2006.01)
*E21D 21/00* (2006.01)

(52) U.S. Cl.
CPC ..... *E21D 20/025* (2013.01); *E21D 11/10* (2013.01); *E21D 21/006* (2016.01); *E21D 21/008* (2013.01); *E21D 21/0086* (2013.01)

(58) Field of Classification Search
CPC ..... E21D 21/0086; E21D 23/0008; E21D 23/0013; E21D 11/006; E21D 11/15; E21D 11/155; E21D 11/18; E21D 11/28
See application file for complete search history.

(56) References Cited

U.S. PATENT DOCUMENTS 5,417,520 A * 5/1995 Rastall ..... F16B 39/284 405/259.1
5,525,013 A * 6/1996 Seegmiller ..... E21D 21/008 405/259.4

(Continued)

FOREIGN PATENT DOCUMENTS

CN 200971786 Y 11/2007
CN 106401614 A 2/2017

(Continued)

OTHER PUBLICATIONS

Machine Translation CN_213980819; Wang et al.; 2021 (Year: 2021).*

*Primary Examiner* — Benjamin F Fiorello
(74) *Attorney, Agent, or Firm* — Nitin Kaushik

(57) ABSTRACT

A tunnel constraint anchor cable and a method for improving stability of an initial support structure. The tunnel constraint anchor cable comprises steel strands (1) anchored in surrounding rock, first anchor plates (2) and first anchorage devices (3) which are installed on the surface of the surrounding rock, longitudinal connection members (5) installed between two adjacent steel ribs (4), and second anchor plates (6) and second anchorage devices (7) which are installed on the longitudinal connection members (5). With the support of the tunnel constraint anchor cable, the ability of the initial support structure to resist self instability and destruction is improved, overall settlement and convergence deformation of the initial support structure can also be suppressed. The method for improving stability of an initial support structure has the characteristics of simplicity, speed, reliability, and avoiding interference with subsequent construction processes of tunnels.

10 Claims, 5 Drawing Sheets

(56) References Cited

U.S. PATENT DOCUMENTS

| | | | | |
|---|---|---|---|---|
| 10,704,389 | B2 * | 7/2020 | Mirabile | E21D 21/0086 |
| 11,753,936 | B2 * | 9/2023 | Wang | E21D 11/152 405/150.1 |
| 12,037,904 | B1 * | 7/2024 | Hu | E21D 11/152 |
| 12,084,971 | B1 * | 9/2024 | Lei | E21D 11/107 |
| 2019/0071968 | A1 * | 3/2019 | Chen | E21D 11/105 |

FOREIGN PATENT DOCUMENTS

| | | | | |
|---|---|---|---|---|
| CN | 113107525 | A | | 7/2021 |
| CN | 213980819 | U | * | 8/2021 |

* cited by examiner

TUNNEL CONSTRAINT ANCHOR CABLE AND METHOD FOR IMPROVING STABILITY OF INITIAL SUPPORT STRUCTURE

CROSS-REFERENCE TO RELATED APPLICATIONS

The application claims priority to Chinese patent application No. 202210338722.2, filed on Mar. 30, 2022, the entire contents of which are incorporated herein by reference.

TECHNICAL FIELD

The present invention relates to the field of tunnel engineering, in particular to a tunnel constraint anchor cable and a method for improving stability of an initial support structure.

BACKGROUND

Initial support for soft rock tunnels mainly consist of steel ribs, sprayed concrete, etc., with a thickness of 26-28 cm. Compared with a secondary lining of tunnels with a relatively large thickness and a relatively large stiffness, the initial support has a relatively small thickness but certain flexibility, belonging to a thin-walled arch structure. Bearing capacity of the initial support is not only related to material strength and structural stiffness, but also closely related to its structural stability. Especially in construction of large-span soft rock tunnels, the stability of the initial support structure will be significantly reduced, which is prone to instability and destruction to cause early loss of the bearing capacity, thereby exacerbating occurrence of large deformation disasters in the tunnels. To prevent instability and destruction to the initial support structure of the soft rock tunnels, existing technical measures include constraint rods, stabilizing rods, or constraint anchor rods, etc. which essentially belong to different terminology expressions of the same technical measure and can be collectively referred to as the constraint anchor rods. The so-called "constraint anchor rod" is essentially a steel pipe with one end grouted and anchored in a relatively stable rock masses deep in the surrounding rocks and the other end connected to a tunnel steel rib, to achieve constraint of the steel pipe on deformation of an initial support steel rib, thereby improving the stability of the initial support structure.

To truly achieve the effect of effectively constraining the tunnel steel rib, the constraint anchor rod must meet three conditions simultaneously: firstly, the constraint anchor rod must be long enough to penetrate deeper into stable rock masses in the surrounding rocks; secondly, the constraint anchor rod can effectively anchor with the surrounding rocks, such as by using appropriate anchoring manners, and increasing a diameter of the constraint anchor rod, to ensure that the constraint anchor rod has sufficient anchoring force; and thirdly, the constraint anchor rod must be reliably connected to the tunnel steel rib. However, from the perspective of on-site practical effects, the existing technical measures still have the following obvious defects and shortcomings:

(1) the soft rock tunnels are often excavated in sections using methods such as a three-step method. Working space for an upper step is often very limited, and there is a significant height difference with a middle step. When the constraint anchor rod drills holes, a YT-28 handheld pneumatic drill commonly used in tunnels is limited in hole drilling depth and hole drilling diameter. To ensure the hole drilling depth and the hole drilling diameter, if a down-the-hole drilling rig is used, a small down-the-hole drilling rig must be selected. However, on-site tests have shown that positioning and hole drilling operations of the small down-the-hole drilling rig in the tunnels are still extremely inconvenient, and hole drilling efficiency is very low, which is not conducive to on-site construction. As a result of above reasons, the length and the diameter of the constraint anchor rod located on the upper step of the tunnel are limited, which makes it difficult for the constraint anchor rod to penetrate through a loose area of the surrounding rocks to play an effective anchoring role.

(2) Due to oblique upward drilling of the constraint anchor rod on the upper step of the soft rock tunnel, it is difficult to effectively solve the problems of grout run out and grout leakage during grouting anchoring, which makes it difficult to ensure grouting anchoring effects of the constraint anchor rod in the deep surrounding rocks, and it is forced to use oblique downward drilling. The oblique downward drilling is conducive to grouting, and it also exerts bending resistance and shear resistance of the rod to a certain extent, but it is not conducive to exerting an axial bearing advantage of the constraint anchor rod and its constraint effect on the initial support of the tunnel.

(3) The constraint anchor rod is connected to the steel rib through welding to the contact parts with the longitudinal connection members. A welding operation takes a long time, and is easily affected by human factors of operators, making it difficult to ensure the reliability of the connection between the constraint anchor rod and the steel rib.

In summary, there are still a series of technical problems that are difficult to solve in drilling, anchoring, connection and other processes of the constraint anchor rod used for improving the stability of the initial support structure at the upper step of the soft rock tunnels. As a result, it is difficult to achieve expected technical effects of the constraint anchor rod. Therefore, it is necessary to propose a measure for controlling the stability of the initial support structure and a construction method, which are simple in construction, high in construction efficiency and capable of ensuring technical effects.

SUMMARY

In response to above technical problems, the present invention provides a tunnel constraint anchor cable and a method for improving stability of an initial support structure, effectively improving the stability of the initial support structure in soft rock tunnels.

A technical solution adopted by the present invention is as follows:

the tunnel constraint anchor cable includes steel strands anchored in surrounding rocks, first anchor plates and first anchorage devices installed on surfaces of the surrounding rocks, longitudinal connection members installed between two adjacent steel ribs, and second anchor plates and second anchorage devices installed on the longitudinal connection members, where the longitudinal connection members are arranged between the two adjacent steel ribs for initial support, and a third preformed hole convenient for the steel strands to penetrate through is set in a center of each longitudinal connection member;

a first preformed hole and a second preformed hole having diameters matching with diameters of the steel strands are respectively formed in a center of each first anchor plate and a center of each second anchor plate; and one end of each steel strand is anchored deep in the surrounding rocks, and the other end penetrates through the first preformed holes and the second preformed holes in sequence, and the first anchorage devices and the second anchorage devices respectively lock the steel strands after retightening force is applied.

In the tunnel constraint anchor cable, two ends of the longitudinal connection members are tightly attached to inner sides of the steel rib flanges near the surrounding rocks and contact parts between the longitudinal connection members and the steel ribs are welded firmly.

In the tunnel constraint anchor cable, the steel strands are 5-12 m in lengths and 17-25 mm in diameters, and 4-8 steel strands are arranged between every two steel ribs.

In the tunnel constraint anchor cable, the longitudinal connection members adopt 114 or 116 I-steels, and have a length 6-8 cm smaller than a spacing between the every two adjacent steel ribs.

In the tunnel constraint anchor cable, the first anchor plates are 28-32 cm in lengths, 28-32 cm in widths and 14-16 mm in thicknesses, and the first preformed holes are round holes, and have a hole diameter 4-6 mm larger than the diameters of the steel strands.

In the tunnel constraint anchor cable, the second anchor plates are 14-16 cm in lengths, 10-12 cm in widths and 14-16 mm in thicknesses, and the second preformed holes are round holes, and have a hole diameter 4-6 mm larger than the diameters of the steel strands.

In the tunnel constraint anchor cable, the third preformed holes are strip holes set in a length direction of the longitudinal connection members.

In the tunnel constraint anchor cable, the first anchorage devices and the second anchorage devices all match with the diameters of the steel strands.

A method for improving stability of an initial support structure through the tunnel constraint anchor cable includes the following steps:

[1] drilling holes:

[1.1] performing initial shotcrete on rock surfaces of surrounding rocks after tunnel excavation;

[1.2] drilling holes according to set quantity in designed positions between two adjacent steel ribs, and at a distance of 0.8-1.2 m or more from an arch springing, with a diameter of 28-32 mm and a depth of 5-12 m;

[2] installing a resin anchoring agent:

after drilled holes are cleaned, delivering resin anchoring agent cartridges into designated positions of the drilled holes through plastic pipes, and then compacting the resin anchoring agent in the drilled holes, wherein a cumulative length of the resin anchoring agent cartridges is 1.2-1.8 m;

[3] delivering the steel strands into the holes and stirring the anchoring agent for anchoring:

after the steel strands are manually delivered into positions where the resin anchoring agent is located in the drilled holes, installing a stirring driver at lower ends of the steel strands, enabling a drilling rig to drive the stirring driver and the steel strands to rotate, to stir the resin anchoring agent cartridges while keeping the drilling rig moving forward, controlling stirring time to be 20-30 s, and controlling the length, exposed to an initial support surface, of the steel strands to be 25-30 cm;

[4] applying pretightening force to the steel strands from the surfaces of the surrounding rocks:

[4.1] 10-15 min after finishing stirring the resin anchoring agent cartridges, installing the first anchor plates and the first anchorage devices on the surfaces of the surrounding rocks in sequence;

[4.2] applying the pretightening force to the steel strands by using a tensioning machine tool, and then locking the steel strands for the first time by using the first anchorage devices, thereby achieving active reinforcement of the surrounding rocks by a constraint anchor cable support system;

[5] connecting the steel strands to the steel ribs:

[5.1] erecting the steel ribs according to a set spacing;

[5.2] installing the longitudinal connection members to enable the steel strands to penetrate through the third preformed holes, then enabling two ends of the longitudinal connection members to be tightly attached to the flanges on one sides of steel ribs close to the surrounding rocks and welding contact parts between the longitudinal connection members and the steel ribs;

[5.3] installing the second anchor plates and the second anchorage devices in sequence, applying the pretightening force to the steel strands by using the tensioning machine tool again, and locking the steel strands for the second time by using the second anchorage devices, thereby achieving constraint fixation of the steel ribs by the tunnel constraint anchor cable, wherein the pretightening force is 6-10 kN;

[5.4] cutting off excess exposed parts of the steel strands by using an angle grinder; and

[6] spraying the shotcrete again to a designed thickness.

In the method for improving stability of an initial support structure, drilling holes in Step [1] is performed using a single body type pneumatic anchor rod drilling rig with a hollow hexagonal extension drill rod and a matching drill bit.

The tunnel constraint anchor cable and the method for improving stability of an initial support structure disclosed by the present invention have the following beneficial effects:

(1) the small-diameter steel strands are used for replacing large-diameter steel pipes used for the constraint anchor rods, and a technical measure of the tunnel constraint anchor cable is proposed to improve the stability of the initial support structure of the tunnel. The small-diameter steel strands have certain flexibility, and their installing length is not limited by construction space of the tunnel. Hole drilling required for installing the steel strands is performed by using the single body type pneumatic anchor rod drilling rig, which is equipped with a long drill rod. The hole drilling depth can reach 12 m or more, ensuring that the constraint anchor cable can penetrate into the relatively stable rock masses deep in the surrounding rocks. The hole drilling efficiency is high. Problems of limitations of the construction space on the upper step of the tunnel, limited hole drilling depth of the YT-28 handheld pneumatic drill commonly used in the tunnels, inconvenience in hole drilling operations and low efficiency of the down-the-hole drilling rig, etc., are avoided.

(2) The steel strands in the tunnel constraint anchor cable of the present invention are anchored to the surrounding rocks through the resin anchoring agent, the anchoring force can be quickly obtained, and the problems of grout runout and grout leakage caused by the oblique upward grouting anchoring of the constraint anchor rod are completely avoided, thereby ensuring anchoring effects. At the same time, the constraint anchor cable can be installed on the vertical surfaces of the surrounding rocks (oblique upward)

at tunnel arches, the tensile performance of the steel strands can be fully exerted, and the tensile strength of the steel strands can reach 1860 MPa or more.

(3) The tunnel constraint anchor cable disclosed by the present invention applies the pretightening force to the steel strands on the surfaces of the surrounding rocks by using the tensioning machine tool, and the steel strands are locked for the first time by the anchors installed on the surfaces of the surrounding rocks, thereby achieving active reinforcement of the surrounding rocks by the constraint anchor cable support system. However, the constraint anchor rod has no such technical effects. In addition, the tensioning machine tool is used for applying the pretightening force to the steel strands again on the surfaces of the longitudinal connection members, and the anchors installed on the longitudinal connection members lock the steel strands for the second time, thereby achieving constraint fixation of the steel ribs by the constraint anchor cable support system. The connection manner between the restraint anchor cable and the steel ribs is simpler, faster, and more reliable.

(4) One end of the tunnel constraint anchor cable of the present invention is anchored to the relatively stable rock masses deep in the surrounding rocks, and the other end is connected to the initial support steel ribs, enhancing the constraint effects on the initial support structure. While the ability of the initial support structure to resist self instability and destruction is improved, overall settlement and convergence deformation of the initial support structure can also be suppressed, without need for temporary inverts or transverse supports, achieving "using cables instead of supports" and avoiding interference with subsequent construction processes.

Figure 1:
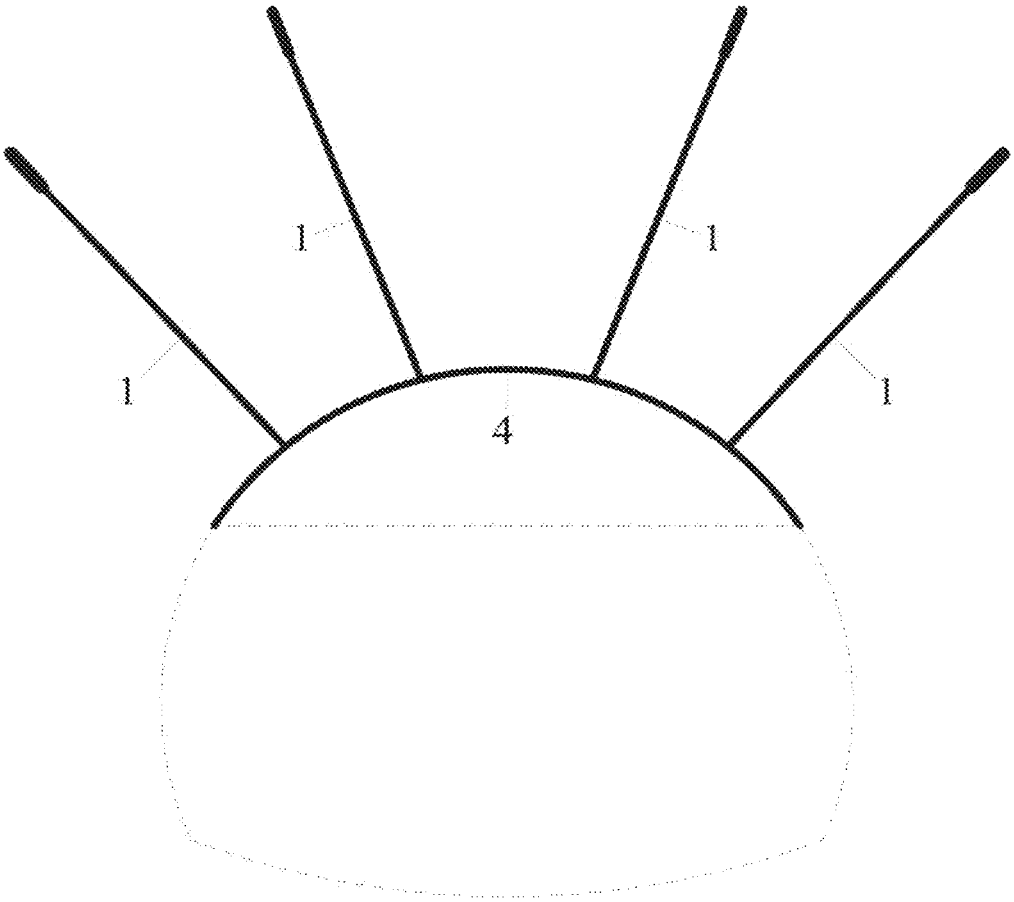
FIG. 1 shows a schematic diagram of layout of a tunnel constraint anchor cable support system according to an embodiment of the present invention.

Reference Numerals: 1—steel strand 2—first anchor plate; 3—first anchorage device; 4—steel rib; 5—longitudinal connection member; 6—second anchor plate; 7—second anchorage device; 8—third preformed hole; 9—first preformed hole; 10—second preformed hole.

DETAILED DESCRIPTION OF THE EMBODIMENTS

To make the objectives, technical solutions, and advantages of the present invention clearer, the following further describes the present invention in detail with reference to the accompanying drawings and embodiments. It should be understood that, specific embodiments described herein are merely used to explain the present invention but not to limit the present invention.

On the contrary, the present invention encompasses any substitution, modification, equivalent methods, and solutions defined by the claims within the essence and scope of the present invention. Furthermore, in order to provide the public with a better understanding of the present invention, some specific details are described in detail in the following description of the present invention. For those skilled in the art, without the description of these detailed parts, the present invention can be fully understood.

Figure 2:
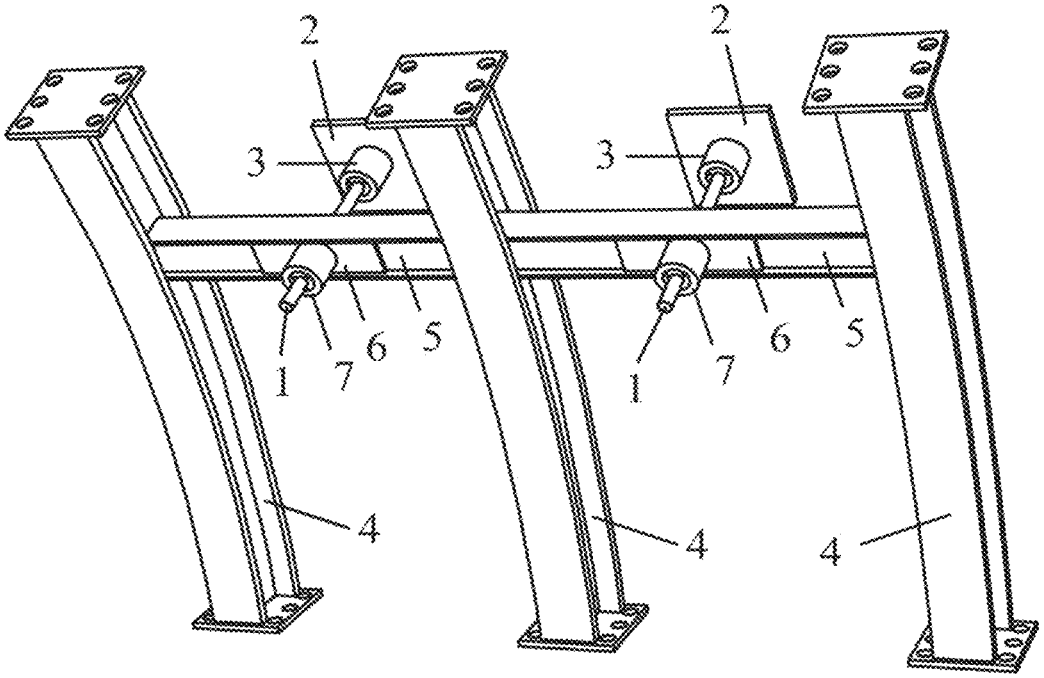
FIG. 2 shows a three-dimensional schematic diagram of a tunnel constraint anchor cable support system according to an embodiment of the present invention.

As shown in FIGS. 1-2, the present invention takes construction of a constraint anchor cable arranged on upper step of a tunnel as an example to introduce the specific technical solution of the present invention:

A tunnel constraint anchor cable consists of steel strands 1 anchored in surrounding rocks, first anchor plates 2, first anchorage devices 3, longitudinal connection members 5, second anchor plates 6 and second anchorage devices 7, where the first anchor plates 2 and the first anchorage devices 3 are installed on surfaces of the surrounding rocks, the longitudinal connection members 5 are installed between two adjacent steel ribs 4, and the second anchor plates 6 and the second anchorage devices 7 are installed on the longitudinal connection members 5.

The longitudinal connection members 5 are arranged between the two adjacent steel ribs 4 for initial support, two ends of the longitudinal connection members are tightly attached to inner sides of the steel rib flanges close to the surrounding rocks and contact parts between the longitudinal connection members and the steel ribs are welded and A third preformed hole 8 convenient for the steel strands to penetrate through is set in each longitudinal connection member 5.

Figure 3:
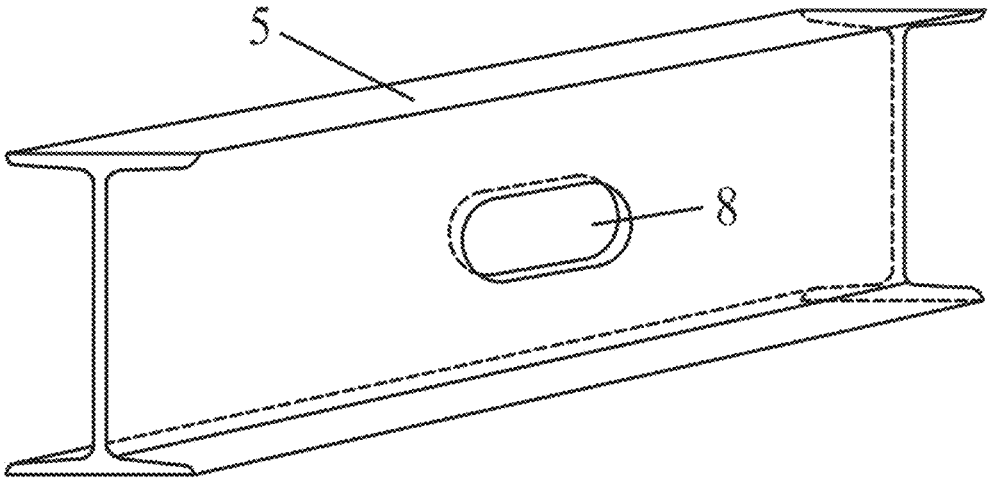
FIG. 3 shows a schematic diagram of longitudinal connection members according to an embodiment of the present invention.
Figure 4:
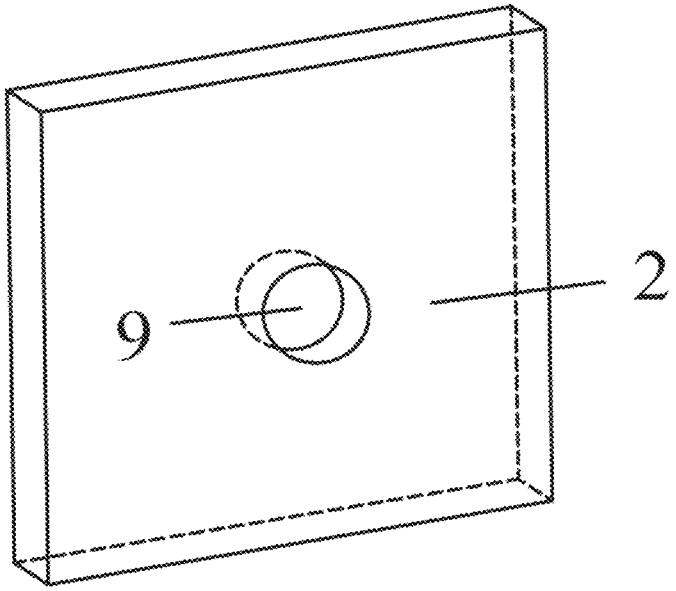
FIG. 4 shows a schematic diagram of first anchor plates according to an embodiment of the present invention.
Figure 5:
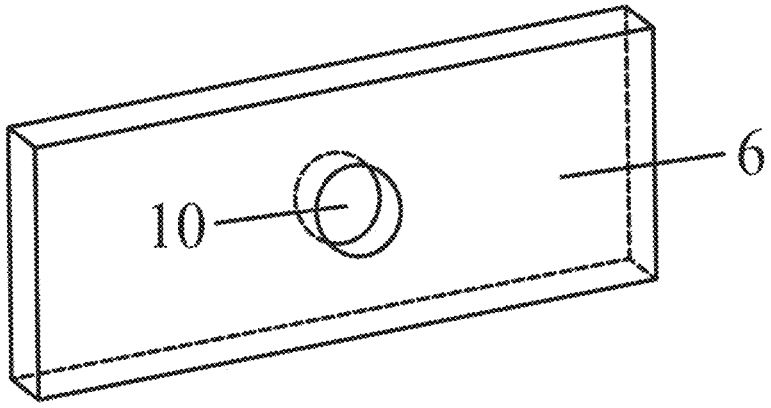
FIG. 5 shows a schematic diagram of second anchor plates according to an embodiment of the present invention.

As shown in FIG. 3-FIG. 5, a first preformed hole 9 and a second preformed hole 10 having diameters matching with diameters of the steel strands 1 are respectively formed in a center of each first anchor plate 2 and a center of each second anchor plate 6, and the first preformed holes 9 and the second preformed holes 10 are all round holes. The third preformed holes 8 are strip holes set in a length direction of the longitudinal connection members 5, and the length of the strip holes is 15-20 cm, to be convenient for installation of the longitudinal connection members 5.

One end of each steel strand 1 is anchored deep in the surrounding rocks, and the other end (exposed end) firstly penetrates through the first preformed holes 9, and the first anchorage devices 3 lock the steel strands 1 for the first time after the pretightening force is applied to the steel strands; and then the other end penetrates through the second preformed holes 10, and the second anchorage devices 7 installed on the longitudinal connection members lock the steel strands 1 for the second time after the pretightening force is applied to the steel strands.

The steel strands 1 are 10 m in lengths and 21.8 mm in diameters, and 4 steel strands are arranged between every two steel ribs on the upper step of the tunnel. The longitudinal connection members 5 adopt 116 I-steels, and have a length 6 cm smaller than a designed spacing between the steel ribs.

The first anchor plates 2 are 30 cm in lengths, 30 cm in widths and 16 mm in thicknesses, and a central hole diameter of each first anchor plate 2 is 5 mm larger than the diameters of the steel strands 1. The second anchor plates 6 are 16 cm in lengths, 12 cm in widths and 16 mm in thicknesses, and a central hole diameter of each second anchor plate 6 is 5 mm larger than the diameters of the steel strands 1. The first anchorage devices 3 and the second anchorage devices 7 all match with the diameters of the steel strands.

A method for improving stability of an initial support structure through the tunnel constraint anchor cable of the present invention includes the following steps:

[1] Hole drilling is performed:

[1.1] after excavation of the upper steps of the tunnel, initial shotcrete is immediately performed on rock surfaces to reduce impacts of falling blocks from vaults on the hole drilling construction of the constraint anchor cable.

[1.2] Between the two steel ribs 4 to be installed on the upper step of the tunnel, hole drilling positions of the constraint anchor cable are marked on the surfaces of the surrounding rocks in a circumferential direction of the tunnel to ensure that the drilled holes are located between the adjacent two steel ribs, in order to facilitate the installation of the longitudinal connection members 5; the specific positions of the drilled holes in the circumferential direction of the tunnel should be determined comprehensively based on the number of the constraint anchor cables, conditions of the surrounding rocks, and positions of steel rib connecting plates; and where, the drilled holes of the constraint anchor cables on two sides of arch springings near the upper step of the tunnel are set in 1.2 m above the arch springing.

[1.3] Hole drilling is performed on surfaces of vertical surrounding rocks at positions of marked drilled holes by a single body type pneumatic anchor rod drilling rig matching with a hollow hexagonal extension drill rod and a drill bit of <D 32 mm.

[1.4] The hole drilling depth is determined comprehensively based on the tunnel over-excavation situation and exposed length requirements of the steel strands 1, to ensure that steel strands 1 can be effectively connected to the longitudinal connection members 5.

[2] A resin anchoring agent is installed:

[2.1] The steel strands 1 in the constraint anchor cable support system are anchored with the resin anchoring agent at ends. Before resin anchoring agent cartridges are delivered into the drilled holes, the drilled holes are firstly cleaned.

[2.2] The resin anchoring agent cartridges are delivered into the designated positions of the drilled holes through plastic pipes, and the resin anchoring agent in the drilled holes is compacted.

[2.3] A cumulative length of the resin anchoring agent cartridges should not be less than a designed length of an anchoring section of the constraint anchor cable, and is 1.2-1.8 m.

[3] The steel strands 1 are delivered into the holes and the anchoring agent is stirred for anchoring:

[3.1] after the steel strands 1 are manually delivered into positions where the resin anchoring agent is located in the drilled holes, a stirring driver is installed at lower ends of the steel strands 1, and a drilling rig drives the stirring driver and the steel strands to rotate, to stir the resin anchoring agent cartridges.

[3.2] While the resin anchoring agent is stirred, the drilling rig is kept moving forward, and stirring time is controlled to be 20-30 s, to ensure that the anchoring agent is uniformly stirred.

[3.3] In the process of advancing the steel strands 1 by the drilling rig, the following requirements should be paid attention to: the final exposed length of the steel strands 1 should not be too short or too long, and is determined on a standard that the final exposed length exceeds the surface of the initial support by 25 cm.

[4] Pretightening force is applied to the steel strands 1 on the surfaces of the surrounding rocks:

[4.1] 10-15 min after finishing stirring the resin anchoring agent cartridges, the first anchor plates 2 and the first anchorage devices 3 are installed on the surfaces of the surrounding rocks in sequence.

[4.2] The pretightening force is applied to the steel strands 1 by using a tensioning machine tool to a proper extent once, and then the steel strands 1 are locked for the first time by using the first anchorage devices 3 installed on the surfaces of the surrounding rocks, thereby achieving active reinforcement of the surrounding rocks by a constraint anchor cable support system.

[5] The steel strands 1 are connected to the steel ribs:

[5.1] after the pretightening force is applied to the steel strands 1 on the surfaces of the surrounding rocks, the steel ribs are erected timely, and the spacing between the steel ribs should strictly meet design requirements.

[5.2] The longitudinal connection members 5 are installed: the steel strands 1 penetrate through the third preformed holes 8 in the longitudinal connection members 5, and then two ends of the longitudinal connection members 5 should be tightly attached to the flanges on one sides of steel ribs close to the surrounding rocks, and contact parts between the longitudinal connection members and contact parts between the longitudinal connection members and the steel ribs are welded.

[5.3] The second anchor plates 6 and the anchorage devices 7 on the longitudinal connection members 5 are installed in sequence, then the pretightening force is applied to the steel strands 1 by using the tensioning machine tool again, and the steel strands 1 are locked for the second time by using the second anchorage devices 7 on the longitudinal connection members, thereby achieving constraint fixation of the steel ribs by the constraint anchor cable support system, and the pretightening force this time should be controlled within 6-10 kN to avoid the steel ribs from being pulled to shift.

[5.4] Excess exposed parts of the steel strands are cut off with an angle grinder, and it is advisable to expose 5 cm of the steel strands 1 to the second anchorage devices installed on the longitudinal connection members 5.

[6] The shotcrete is sprayed on the rock surface again to a designed thickness to finish construction operations of the initial support.

The small-diameter steel strands are used for replacing large-diameter steel pipes used for the constraint anchor rods, and a technical measure of the tunnel constraint anchor cable is proposed to improve the stability of the initial support structure of the tunnel. Hole drilling required for installing the steel strands is performed by using the single body type pneumatic anchor rod drilling rig, which is equipped with a long drill rod. The hole drilling depth can reach 12 m or more, ensuring that the constraint anchor cable can penetrate into the relatively stable rock masses deep in the surrounding rocks. The hole drilling efficiency is high. Problems of limitations of the construction space on the upper step of the tunnel, limited hole drilling depth of the YT-28 handheld pneumatic drill commonly used in the tunnels, inconvenience in hole drilling operations and low efficiency of the down-the-hole drilling rig, etc., are avoided.

The steel strands in the tunnel constraint anchor cable of the present invention are anchored to the surrounding rocks through the resin anchoring agent, the anchoring force can be quickly obtained, and the problems of grout run out and grout leakage caused by the oblique upward grouting anchoring of the constraint anchor rod are completely avoided, thereby ensuring anchoring effects.

At the same time, the constraint anchor cable can be installed on the vertical surfaces of the surrounding rocks (oblique upward) at tunnel arches, the tensile performance of the steel strands can be fully exerted, and the tensile strength of the steel strands can reach 1860 MPa or more.

The tunnel constraint anchor cable disclosed by the present invention applies the pretightening force to the steel strands on the surfaces of the surrounding rocks by using the tensioning machine tool, and the steel strands are locked for the first time by the first anchorage devices 3 installed on the surfaces of the surrounding rocks, thereby achieving active reinforcement of the surrounding rocks by the constraint anchor cable support system. However, the constraint anchor rod has no such technical effects. In addition, the tensioning machine tool is used for applying the pretightening force to the steel strands again on the surfaces of the longitudinal connection members, and the second anchorage devices 7 installed on the longitudinal connection members lock the steel strands for the second time, thereby achieving constraint fixation of the steel ribs by the constraint anchor cable support system. The connection manner between the restraint anchor cable and the steel ribs is simpler, faster, and more reliable.

One end of the tunnel constraint anchor cable of the present invention is anchored to the relatively stable rock masses deep in the surrounding rocks, and the other end is connected to the initial support steel ribs, enhancing the constraint effects on the initial support structure. While the ability of the initial support structure to resist self instability and destruction is improved, overall settlement and convergence deformation of the initial support structure can also be suppressed, without need for temporary inverts or transverse supports, achieving "using cables instead of supports" and avoiding interference with subsequent construction processes.

In summary, the tunnel constraint anchor cable and the method for improving stability of an initial support structure disclosed by the present invention can meet three conditions simultaneously which must be met for achieving effective constraint on the tunnel steel ribs: firstly, the constraint anchor cable must be long enough to penetrate deeper into stable rock masses in the surrounding rocks; secondly, the constraint anchor cable can be quickly and effectively anchored with the surrounding rocks, to ensure that the constraint anchor cable has sufficient anchoring force; and thirdly, the constraint anchor cable is reliably connected to the tunnel steel ribs. Furthermore, the technical effects of the constraint anchor cable support system are ensured, and the stability of the initial support structure of soft rock tunnels can be effectively improved. At the same time, the overall settlement and convergence deformation of the initial support structure can also be suppressed.

The above contents are only for explaining the technical concept of the present invention and cannot limit the scope of protection of the present invention. Any modifications made according to the technical concept proposed in the present invention and based on the technical solution shall fall within the scope of protection of the claims of the present invention.

What is claimed is:

1. A tunnel constraint anchor cable, comprising steel strands (1) anchored in surrounding rocks, first anchor plates (2) and first anchorage devices (3) installed on surfaces of the surrounding rocks, longitudinal connection members (5) installed between two adjacent steel ribs (4), and second anchor plates (6) and second anchorage devices (7) installed on the longitudinal connection members (5), wherein the longitudinal connection members (5) are arranged between the two adjacent steel ribs (4) for initial support, and a third preformed hole (8) for the steel strands (1) to penetrate through is set in a center of each longitudinal connection member (5);

a first preformed hole (9) and a second preformed hole (10) having diameters larger than diameters of the steel strands (1) are respectively formed in a center of each first anchor plate (2) and a center of each second anchor plate (6); and one end of each steel strand (1) is anchored in the surrounding rocks, and the other end penetrates through the first preformed holes (9) and the second preformed holes (10) in sequence, and the first anchorage devices (3) and the second anchorage devices (7) respectively lock the steel strands (1) after the pretightening force is applied.

2. The tunnel constraint anchor cable according to claim 1, wherein two ends of the longitudinal connection members (5) are attached to inner sides of flanges on one sides, close to the surrounding rocks, of the steel ribs and contact parts between the longitudinal connection members and the steel ribs are welded.

3. The tunnel constraint anchor cable according to claim 1, wherein the steel strands are 5-12 m in lengths and 17-25 mm in diameters, and 4-8 steel strands are arranged between every two adjacent steel ribs.

4. The tunnel constraint anchor cable according to claim 1, wherein the longitudinal connection members are formed of I-shaped steels selected from 114 and 116, and have a length 6-8 cm smaller than a spacing between every two adjacent steel ribs.

5. The tunnel constraint anchor cable according to claim 1, wherein the first anchor plates (2) are 28-32 cm in lengths, 28-32 cm in widths and 14-16 mm in thicknesses, and the first preformed holes (9) are round holes, and have a hole diameter 4-6 mm larger than the diameters of the steel strands.

6. The tunnel constraint anchor cable according to claim 1, wherein the second anchor plates (6) are 14-16 cm in lengths, 10-12 cm in widths and 14-16 mm in thicknesses, and the second preformed holes (10) are round holes, and have a hole diameter 4-6 mm larger than the diameters of the steel strands.

7. The tunnel constraint anchor cable according to claim 1, wherein the third preformed holes (8) are strip holes set in a length direction of the longitudinal connection members (5).

8. The tunnel constraint anchor cable according to claim 1, wherein the first anchorage devices (3) and the second anchorage devices (7) all match with the diameters of the steel strands (1).

9. A method for improving stability of an initial support structure through the tunnel constraint anchor cable according to claim 1, comprising the following steps:

[1] drilling holes:

[1.1] performing initial shotcrete on rock surfaces of surrounding rocks after tunnel excavation;

[1.2] drilling holes according to set quantity in designed positions between two adjacent steel ribs, and at a distance of 0.8-1.2 m or more from an arch springing, with a diameter of 28-32 mm and a depth of 5-12 m;

[2] installing a resin anchoring agent:

after drilled holes are cleaned, delivering resin anchoring agent cartridges into designated positions of the drilled holes through plastic pipes, and then compacting the resin anchoring agent in the drilled holes, wherein a cumulative length of the resin anchoring agent cartridges is 1.2-1.8 m;

[3] delivering the steel strands into the holes and stirring the anchoring agent for anchoring:

after the steel strands are manually delivered into positions where the resin anchoring agent is located in the drilled holes, installing a stirring driver at lower ends of the steel strands, enabling a drilling rig to drive the stirring driver and the steel strands to rotate, to stir the resin anchoring agent cartridges while keeping the drilling rig moving forward, controlling stirring time to be 20-30 s, and controlling the length, exposed to an initial support surface, of the steel strands to be 25-30 cm;

[4] applying pretightening force to the steel strands from the surfaces of the surrounding rocks:

[4.1] 10-15 min after finishing stirring the resin anchoring agent cartridges, installing the first anchor plates and the first anchorage devices on the surfaces of the surrounding rocks in sequence;

[4.2] applying the pretightening force to the steel strands by using a tensioning machine tool, and then locking the steel strands for the first time by using the first anchorage devices, thereby achieving active reinforcement of the surrounding rocks by a constraint anchor cable support system;

[5] connecting the steel strands to the steel ribs:

[5.1] erecting the steel ribs according to a set spacing;

[5.2] installing the longitudinal connection members to enable the steel strands to penetrate through the third preformed holes, then enabling two ends of the longitudinal connection members to be tightly attached to the flanges on one sides of steel ribs close to the surrounding rocks and welding contact parts between the longitudinal connection members and the steel ribs;

[5.3] installing the second anchor plates and the second anchorage devices in sequence, applying the pretightening force to the steel strands by using the tensioning machine tool again, and locking the steel strands for the second time by using the second anchorage devices, thereby achieving constraint fixation of the steel ribs by the tunnel constraint anchor cable, wherein the pretightening force is 6-10 kN;

[5.4] cutting off excess exposed parts of the steel strands by using an angle grinder; and

[6] spraying the shotcrete again to a designed thickness.

10. The method for improving stability of an initial support structure according to claim 9, wherein drilling holes in Step [1] is performed using a single body type pneumatic anchor rod drilling rig with a hollow hexagonal extension drill rod and a matching drill bit.

* * * * *